US006371560B1

(12) United States Patent
Fulford et al.

(10) Patent No.: US 6,371,560 B1
(45) Date of Patent: Apr. 16, 2002

(54) SUPPORT DEVICE FOR A GOLF CAR SEAT ASSEMBLY

(75) Inventors: James M. Fulford, Evans; Donald G. Samuelson, Augusta; Terry L. Canaday, Evans; James K. Caldwell, Martinez; Christian J. Eck, III, Evans; Mark Wisner, Grovetown, all of GA (US)

(73) Assignee: Club Car, Inc., Augusta, GA (US)

( * ) Notice: Subject to any disclaimer, the term of this patent is extended or adjusted under 35 U.S.C. 154(b) by 0 days.

(21) Appl. No.: 09/464,888

(22) Filed: Dec. 16, 1999

(51) Int. Cl.[7] ..... A47C 7/54

(52) U.S. Cl. ..... 297/411.27; 297/183.1; 297/463.1; 297/440.22; 297/440.14; 280/DIG. 5

(58) Field of Search ..... 297/411.2, 411.4, 297/183.1, 183.7, 41.27, 463.1, 463.2, 440.14, 440.1, 440.22; 280/DIG. 5

(56) References Cited

U.S. PATENT DOCUMENTS 2,966,208 A * 12/1960 Good ..... 297/411.27 X
3,323,144 A * 6/1967 Ferris, Jr. ..... 297/411.27 X
3,947,068 A * 3/1976 Buhk ..... 297/411.2 X
5,031,713 A * 7/1991 Criscuolo ..... 280/DIG. 5
5,577,804 A * 11/1996 Tedesco ..... 297/463.1 X
6,070,940 A * 6/2000 Wu ..... 297/463.1 X

* cited by examiner

*Primary Examiner*—Anthony D. Barfield
(74) *Attorney, Agent, or Firm*—Michael Best & Friedrich LLP

(57) ABSTRACT

A support device is provided for a seat assembly of a golf car. The support device has a base including an elongated shell bounding an interior space. The shell preferably has a first, enclosed end, a second, opposing end defining an elongated opening into the interior space and a sidewall extending between the ends. A support tube bounds an interior space and has a generally bended shape and two opposing ends, each tube end being integrally formed with the enclosed end of the base shell. Further, two mounting brackets are each integrally formed with the sidewall of the base shell and each includes a mounting plate. The mounting plate has a first, generally flat surface disposeable against the golf car seat and configured for attachment to the seat assembly to attach the support device to the golf car. Preferably, a plurality of reinforcing ribs extends between opposing interior surfaces of the base shell. Furthermore, another set of reinforcing ribs preferably extend vertically from a second, opposing surface of the mounting bracket plate such that the bracket has a substantial vertical thickness. Preferably, the support device is provided in both a left-hand configuration and a right-hand configuration, such that one device of each configuration is attached to a separate, opposing end of the seat assembly.

16 Claims, 5 Drawing Sheets

SUPPORT DEVICE FOR A GOLF CAR SEAT ASSEMBLY

BACKGROUND OF THE INVENTION

The present invention relates to golf cars, and more particularly to support devices used with golf car seat assemblies.

Combination hip restraint/arm rest/hand grip devices used for the passenger compartment of motorized golf cars are known. Such support devices are typically mounted to each opposing side of a golf car seat and primarily serve three purposes. First, these devices function as a hip restraint by providing a rail or barrier to prevent a person seated in the golf car from sliding off the outer edges of the golf car seat, particularly when the golf car negotiates a turn. In addition, such support devices also typically provide a surface(s) upon which a seated golfer may rest a forearm or an elbow. Further, these support devices can be used as a hand grip to support a seated golfer or to assist a person when entering and exiting the golf car passenger compartment.

One known type of support device is constructed of a metal tube that is formed or bended into an appropriate configuration and is attached to a seat assembly by a pair of brackets, the brackets each having a bearing hole that receives an end of the tube. Such a bended tube support typically includes a cylindrical foam pad or cushion sleeve which, besides being formed of a softer material, increases the outer diameter of a supporting section of the tube to provide a larger, and thus more comfortable, support surface. Generally, without such a cushion sleeve, a metal tube support device does not have a sufficient outer surface area to comfortably support a person's arm as it is not feasible, both in terms of weight and cost, to use a metal tube with a relatively large outer diameter. However, the addition of the separate padded sleeve increases the cost and assembly time for producing the support device.

Another known support device is formed of an injection-molded polymer and includes a bended wall or ledge that serves as the arm support, hip restraint and hand grip. Such devices can be feasibly produced with a supporting wall/ledge having a width appreciably greater than the diameter of the metal tube support, and thus having a larger support surface. However, the wall/ledge of these injection-molded devices have relatively narrow or sharp corners, which make these support devices less comfortable to use as a hand grip than the tubular metal support devices.

Thus, it is apparent that it would be advantageous to provide an alternative support device that overcomes one or more of the limitations of previous devices as set forth above.

SUMMARY OF THE INVENTION

In a first aspect, the present invention is a support device for a seat assembly of a golf car. The device comprises a base and a support tube bounding an interior space and having two opposing ends, at least one tube end being integrally formed with the base. Further, a mounting bracket is integrally formed with the base and includes a generally flat wall portion connectable with the golf car to attach the support device to the car.

In another aspect, the present invention is a seat assembly for a golf car. The seat assembly comprises a seat base mounted to the golf car and having opposing ends and a surface disposed between the ends. A support device is removably attached to the seat base and includes a base. A support tube bounds an interior space and has two opposing ends, at least one tube end being integrally formed with the base, and a support surface disposed adjacent to an end of the seat base. Further, a mounting bracket is integrally formed with the base and includes a generally flat wall portion disposeable against the seat base surface and configured to removably attach the support device to the seat base.

In a further aspect, the present invention is also a support device for a seat assembly of a golf car. The support device comprises a base including an elongated shell bounding an interior space. The base shell has a first, enclosed end, a second, opposing end defining an elongated opening into the interior space and a sidewall extending between the ends. A support tube bounds an interior space and has a generally bended shape and two opposing ends. Each tube end is integrally formed with the enclosed end of the base shell. Further, a mounting bracket is integrally formed with the sidewall of the base shell and includes a generally flat plate. The bracket plate has a first, generally flat surface disposeable against the golf car seat and is configured for attachment to the seat assembly to attach the support device to the golf car.

BRIEF DESCRIPTION OF THE SEVERAL VIEWS OF THE DRAWINGS

The foregoing summary, as well as the detailed description of the preferred embodiments of the invention, will be better understood when read in conjunction with the appended drawings. For the purpose of illustrating the invention, there is shown in the drawings, which are diagrammatic, embodiments that are presently preferred. It should be understood, however, that the invention is not limited to the precise arrangements and instrumentalities shown. In the drawings.

DETAILED DESCRIPTION OF THE INVENTION

Figure 1:
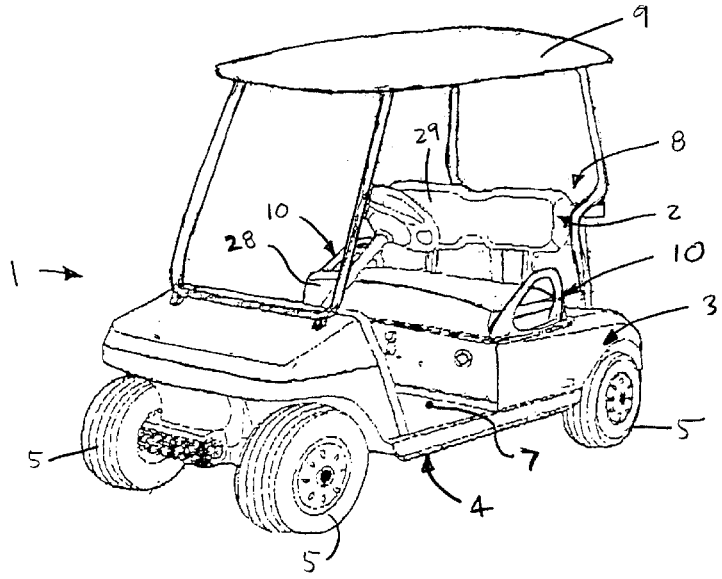
FIG. 1 is a front perspective view of a golf car having a seat assembly incorporating two support devices in accordance with the present invention.

Certain terminology is used in the following description for convenience only and is not limiting. The words "right", left", "lower", "upper", "upward", "down" and "downward" designate directions in the drawings to which reference is made. The words "front", "frontward" and "rear", "rearward" refer to directions toward and away from, respectively, a designated front end of a seat assembly or a specific portion of the support device, the particular meaning intended being readily apparent from the context of the description. The words "inner", "inward" and "outer", "outward" refer to directions toward and away from, respectively, a designated central axis of the seat assembly or the geometric center of a specific portion of the support device, the particular meaning intended being readily apparent from the context of the description. The terminology includes the words specifically mentioned above, derivatives thereof, and words of similar import.

Figure 11:
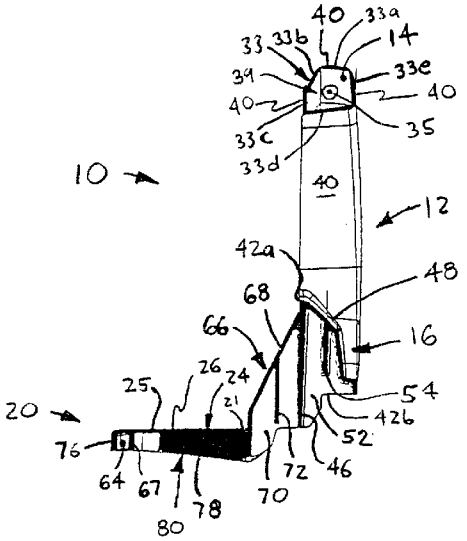
FIG. 11 is a view through line 11—11 of FIG. 6.

Referring now to the drawings in detail, wherein like numbers are used to indicate like elements throughout, there is shown in FIGS. 1–11 a support device 10 for a seat assembly 2 of a golf car 1, in accordance with the present invention. The support device 10 is basically formed of a base 16 and a support tube 12 bounding a generally hollow interior space 14 (FIG. 11). The support tube 12 has two opposing ends 15, 17, with at least one and preferably both tube ends 15 and 17 being integrally formed with/attached to the base 16. Further, at least one and preferably two mounting brackets 20 are each integrally formed with the base 16. Each bracket 20 includes a generally flat wall portion 24 connectable with the golf car 1 to mount or attach the support device 10 to the golf car 1.

The phrases "integrally formed" or "integrally attached", as used throughout the present disclosure, are both intended to convey that the device elements so described, such as the tube ends 15, 17 and the base 16, the base 16 and the brackets 20, etc., are joined at a continuous material interface such that the support device 10 is a one-piece construction. Each of the above-recited primary elements of the support device 10 is described in further detail below.

Figure 2:
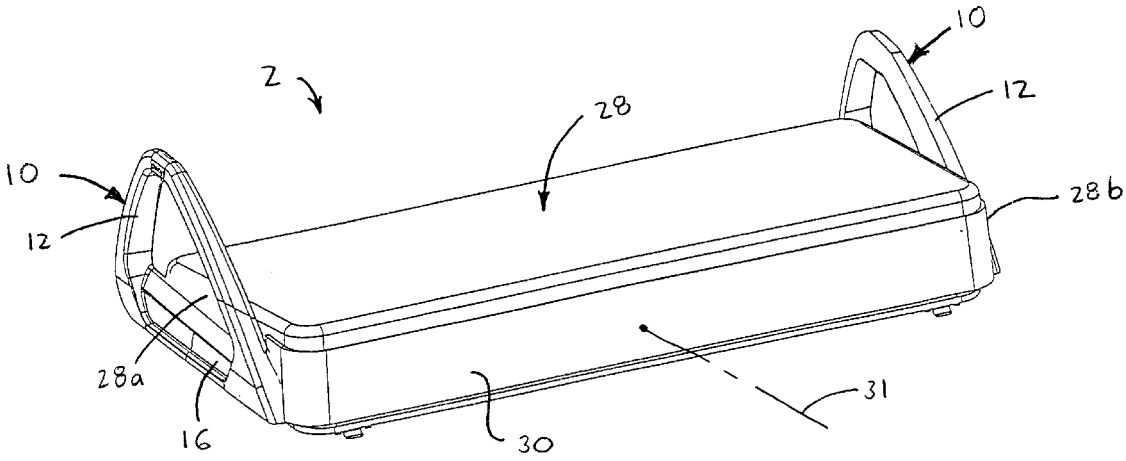
FIG. 2 is a front perspective view of the seat assembly with the two support devices, viewed generally from the side of the seat assembly centerline opposite that of FIG.1.

Referring now to FIGS. 1 and 2, the golf car 1 generally comprises a body 3 mounted to a chassis 4, wheels 5, a motor (not shown) for driving the wheels 5, a passenger area 7, a golf bag storage area 8, a utility storage area (not shown), and a sunroof canopy assembly 9. The seat assembly 2 is disposed within the passenger area 7 and includes the seat base 28 and a seat back 29. Further, the seat assembly 2 has a front end 30 and a central axis 31 extending longitudinally (i.e., with respect to the golf car chassis 4) through the seat assembly 2 and generally perpendicularly with respect to the front end 30 of the seat assembly 2 (see FIG. 2).

Figure 3:
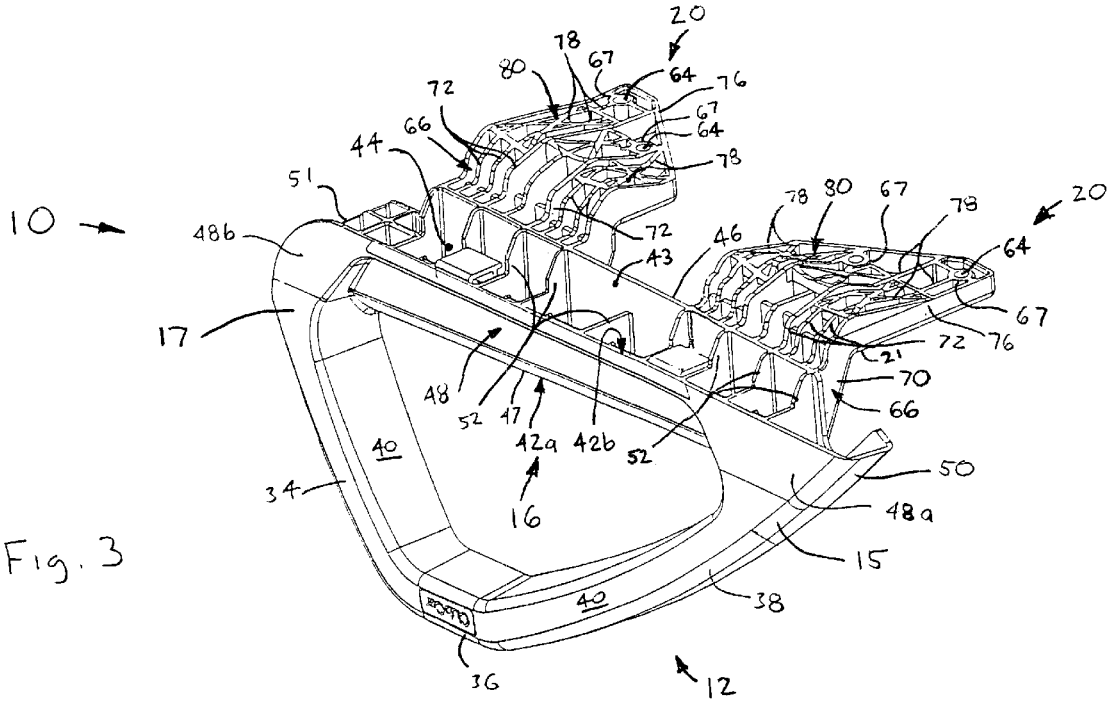
FIG. 3 is a side perspective view of a left-hand construction of the support device, shown in an inverted or "upside-down" position.
Figure 4:
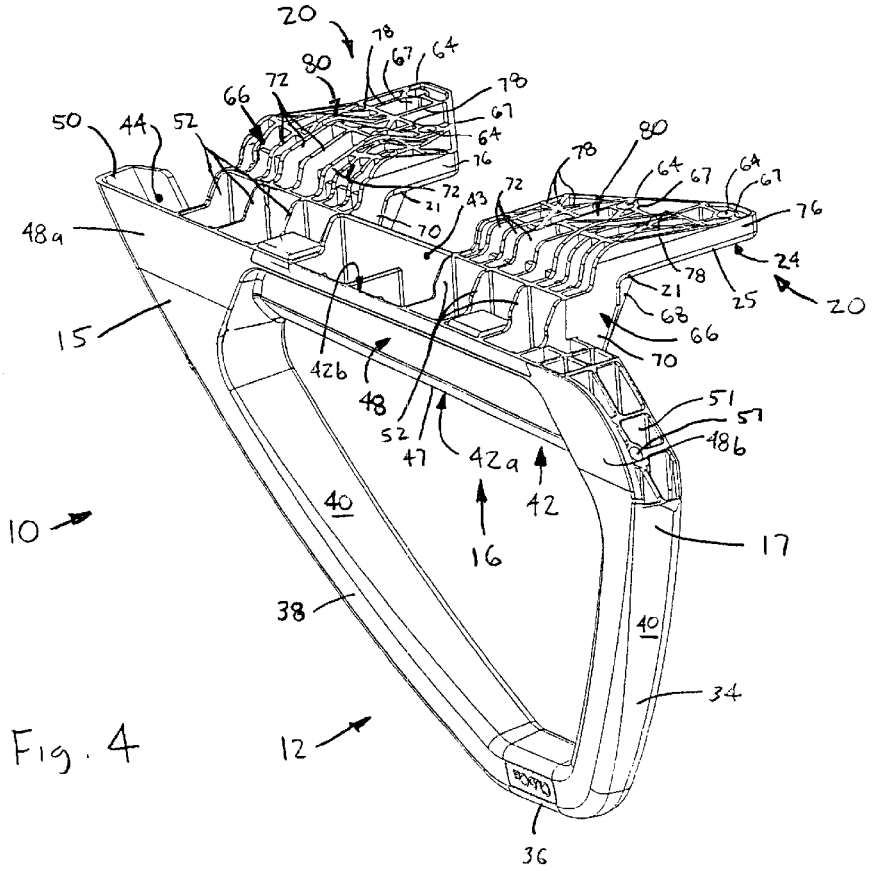
FIG. 4 is a side perspective view of a right-hand construction of the support device, shown in an upside-down position.

Preferably, each seat assembly 2 includes two of the support devices 10 of the present invention, a "right-hand" construction, shown in FIGS. 1, 2 and 4, and a "left-hand" construction shown in FIGS. 1–3 and 5–11, each particular construction being configured to be disposed on an opposing side end 28*a*, 28*b* of the seat base 28. The two constructions of the support device 10 are substantially identical to each other, but are oppositely oriented with respect to (i.e., "mirrored about") the central axis 31 of the seat assembly 2. Therefore, although the left-hand construction of the device 10 is primarily depicted in the drawing figures (FIGS. 1–3 and 5–11), the support device 10 of the present invention is generally described throughout this disclosure without reference to "right-hand" or "left-hand" as each construction includes the same basic sections/portions, as described in detail below.

Figure 5:
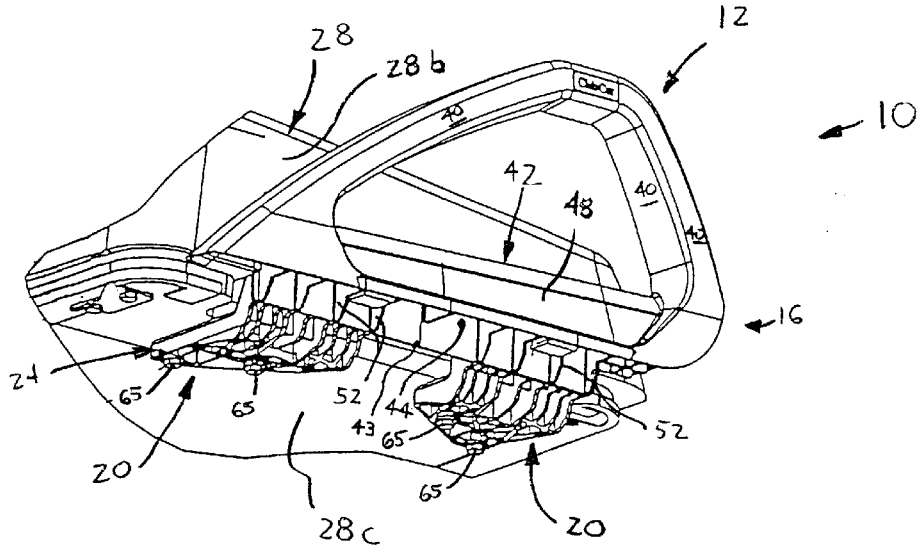
FIG. 5 is another side perspective view of the left-hand construction of the support device, shown in a right-side-up position and mounted to a seat base.
Figure 6:
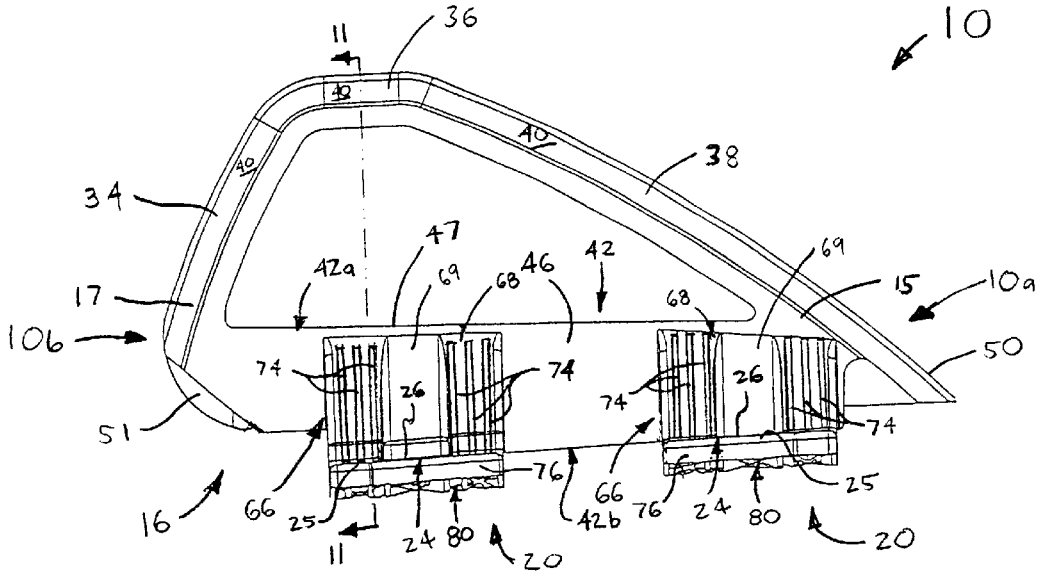
FIG. 6 is left or "inner" side plan view of the left-hand device construction.
Figure 7:
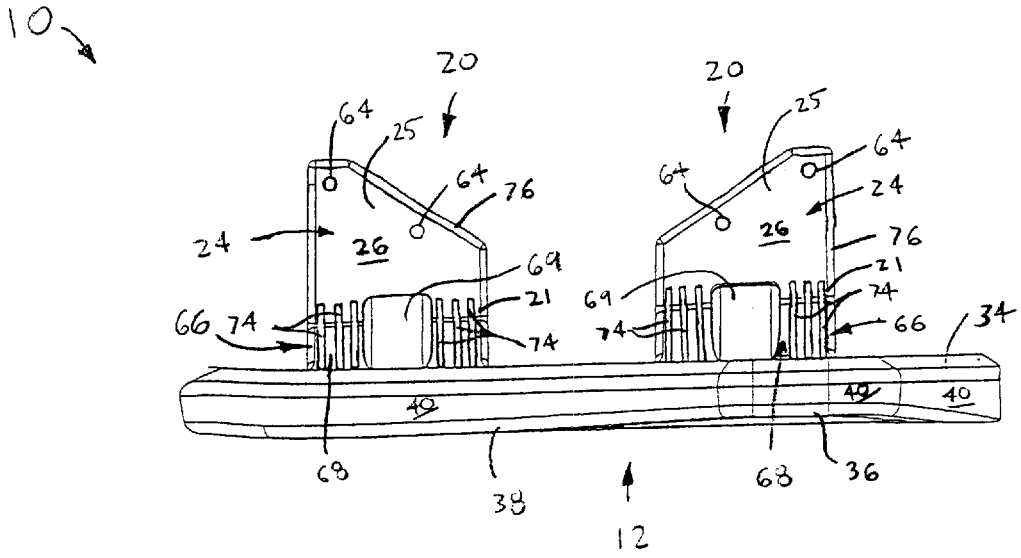
FIG. 7 is a top plan view of the left-hand device construction.

Referring now to FIGS. 3–7 and 11, the support tube 12 is preferably formed of a relatively thin, enclosed wall 33 (see FIG. 11) and has a bended shape similar to an inverted "V". The support tube 12 has three continuous, integrally formed sections 34, 36 and 38, as best shown in FIG. 6. More specifically, a generally vertical rear section 34 extends upwardly from the rear end 17 of the support tube 12 to a central, generally horizontal section 36. The central section 36 extends from the rear section 34 to a front section 38, the front section 38 extending downwardly and forwardly from the central section 36 to the front end 15 of the support tube 12. Although, both ends 15, 17 of the support tube 12 are preferably integrally formed with/attached to the base 16, as described above, it is within the scope of the present invention to construct the support device 10 with only one tube end 15 or 17 connected to the base 16. In such an alternative construction, the other tube end 17, 15, respectively, is an unattached or "free" end (not depicted).

Referring specifically to FIG. 11, the tube wall 33 preferably circumscribes a central axis 35 (shown extending perpendicularly with respect to the drawing page) such that the wall 33 has a generally continuous outer circumferential surface providing a support surface 40. More specifically, the central axis 35 is a bended line that extends between the ends 15, 17 through the geometric center of all transverse cross sections 39 of the wall 33, with the wall 33 completely encircling the axis 35 at all points between the tubes ends 15 and 17. Preferably, the tube wall 33 is formed having five faces 33*a*–33*e* such that the transverse cross sections 39 of the tube 12 are all generally shaped as distorted pentagons, as shown for one cross section in FIG. 11.

Although the above-described structure of the support tube 12 is preferred, it is within the scope of the present invention to construct the support tube 12 in any other appropriate configuration. For example, the tube 12 may have an overall shape that is generally arcuate or hemispherical, generally rectangular or complexly-shaped (none shown), as opposed to being an inverted "V". Further, the tube wall 33 may have transverse cross sections 39 shaped generally rectangular, triangular, circular or any other desired shape and/or may vary between different shapes along the central axis 35 (none shown). The present invention embraces these alternatives and any other appropriate construction of the support tube 12 that enables the support device 10 to have the desired features as discussed herein.

With the above structure of the tube 12, the support surface 40 of the present support device 10 is formed with the following sections/portions. The uppermost face 33*a* (FIG. 11) of the tubular wall 33 at the central and front sections 36, 38, respectively, provide generally flat, horizontal and inclined surface sections, respectively, with a substantial total surface area. These portions of the support surface 40 are particularly suitable for resting a seated golfer's elbow and/or forearm. The innermost wall faces 33*b*, 33*c* (FIG. 11) throughout the three tube sections 34, 36 and 38 present generally flat, vertical or generally vertical surface sections with a substantial total surface area. These particular sections of the support surface 40 provide a substantial barrier for restraining a seated golfer's hips or torso.

Further, the enclosed tubular wall 33 has a relatively large outer circumferential perimeter throughout all three tube sections 34, 36 and 38, such that a substantial outer surface area for hand gripping is provided along generally the entire length of the tube 12. As a further result of being provided by an enclosed tubular wall 33, the support surface 40 is substantially "rounded", i.e., formed without sharp corners, particularly at the upper portions thereof, such that the support tube 12 is comfortable to use as an arm rest, a hip restraint and/or as a hand grip.

By constructing the support section of the device 10 as a tube 12, the support device 10 of the present invention has a support surface 40 with a relatively large total surface area for a given quantity of material used to form the tube 12. In other words, the support device 10 has a support section (i.e., tube 12) formed so as to minimize material usage, but still provides a substantial vertical aspect for hip restraining purposes, a substantial horizontal aspect for arm resting purpose, and a relatively large circumferential perimeter for hand gripping purposes.

Referring now to FIGS. 3–6, 8 and 11, the base 16 preferably includes an elongated shell 42 bounding an interior space 44, such that the two tube ends 15, 17 and the two brackets 20 are integrally attached to the base shell 42, as discussed below. The base shell 42 has a first or upper, enclosed end 42*a* and a second or lower, opposing end 42*b* defining an elongated opening 43 into the interior space 44. Further, the shell 42 also includes a generally vertical inner sidewall 46 and a sloping outer sidewall 48. The upper ends of the two sidewalls 46, 48 converge into a horizontally-extending edge section 47 at the enclosed shell end 42*a* and the lower edges/ends of the sidewalls 46, 48 define major portions of the opening 43 at the second shell end 42*b*. Furthermore, the outer shell sidewall 48 preferably has two outwardly-stepped end sections 48*a*, 48*b* that each substantially blend with connected portions of the tube ends 15 and 17, respectively.

Figure 8:
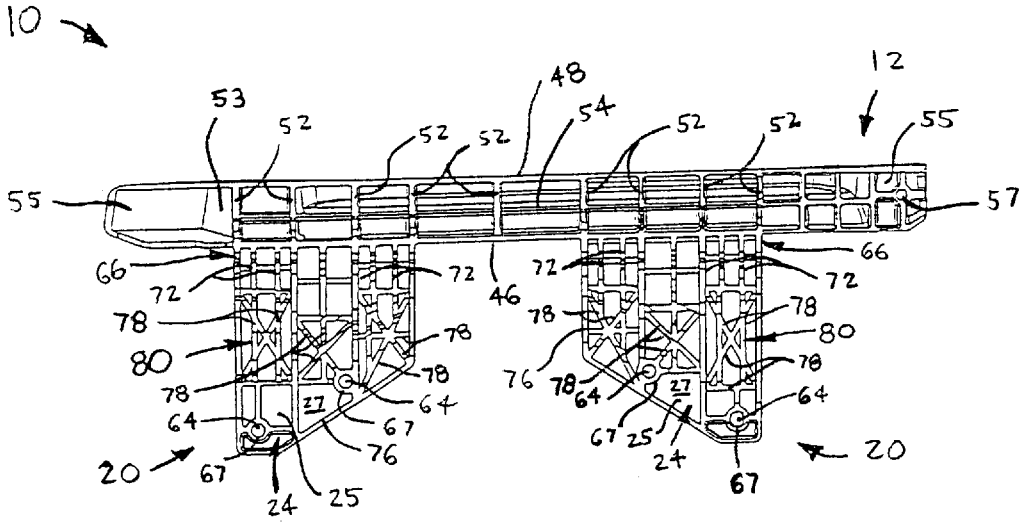
FIG. 8 is a bottom plan view of the left-hand device construction.
Figure 9:
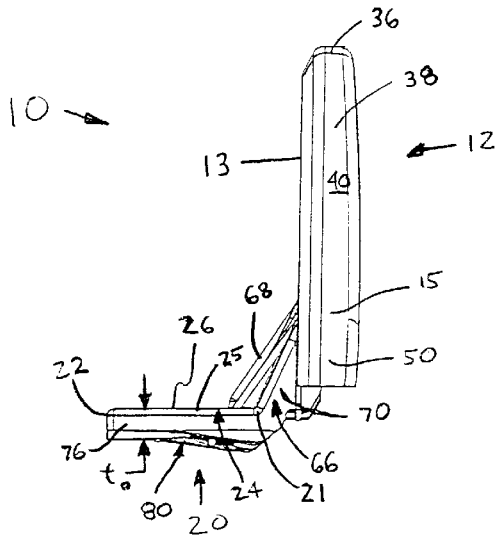
FIG. 9 is a front plan view of the left-hand device construction.
Figure 10:
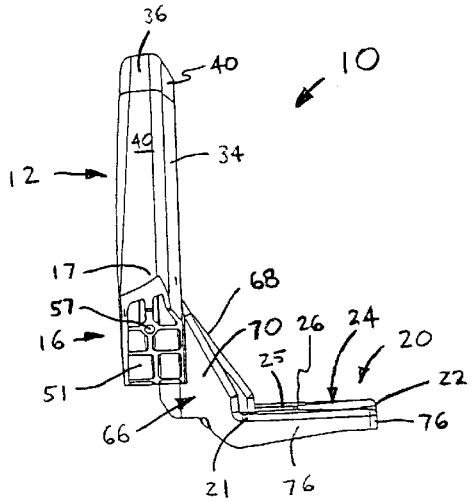
FIG. 10 is a rear plan view of the left-hand device construction.

The base shell 42 preferably further includes a sloped front wall 50 extending between the front end 15 of the support tube 12 and the front ends of the two sidewalls 46, 48. Also, a rear, open section 51 is formed at the intersection of the rear tube end 17 and the two sidewalls 46, 48. As best shown in FIG. 8, the shell upper end 42*a* also includes two horizontally-extending wall sections 53, 55 each located at a separate end of the edge section 47. The wall sections 53, 55 each generally enclose a proximal tube end 15, 17, respectively, to prevent foreign material (e.g., dirt) from entering and becoming trapped within the interior space 14 of support tube 12. Further, a gas port 57 is provided in the rear end wall 55 to enable the support tube 12 to be properly formed during a gas-assist injection molding process, as discussed below.

Referring now to FIGS. 3–5, 8 and 11, the base 16 preferably further includes a plurality of integral, transverse reinforcing ribs 52 disposed within the hollow interior space 44. Each rib 52 extends between a pair of generally facing interior surfaces of the two shell sidewalls 46, 48. Further, a single longitudinal reinforcing rib 54 extends between (and through) the plurality of transverse ribs 52 and generally parallel with the two shell sidewalls 46, 48 as best shown in FIGS. 8 and 11. The reinforcing ribs 52, 54 provide rigidity to the base 16, such that the shell 42, particularly the sidewalls 46, 48, may formed with a relatively minimal wall thickness in order to minimize material usage, without the potential for the sidewalls 46, 48 to either "bow" outwardly or collapse inwardly toward each other.

Although the above-described structure of the base 16 is preferred, it is well within the scope of the present invention to vary the configuration of the base 16. For example, the base 16 may be formed as a generally rectangular, enclosed hollow box as opposed to a open-ended hollow shell or may be formed as a substantially solid section without a hollow interior space (neither shown). Further for example, the base 16 may be formed without reinforcing ribs 52 or 54 or with ribs having a different structure and/or arrangement than as depicted and described (not shown). As yet another example, the support device 10 may be formed without a discernible base section per se and with the bracket(s) 20 integrally formed directly with the support tube 12 (not shown). The present invention embraces these and all other appropriate configurations of the base 16.

Referring again to FIGS. 3–11, as described above, the support device 10 preferably includes two mounting brackets 20 integrally formed with the base 16. Preferably, the wall portion 24 of each bracket 20 is provided by a horizontally-extending plate 25 having a first end 21 connected with the inner surface of the base sidewall 46 and a second, free end 22 (see FIG. 9). Each plate 25 has a first or upper, generally flat mounting surface 26 disposeable against the lower surface 28*c* of the seat base 28, as best shown in FIG. 5, and a second or lower, opposing surface 27. The plates 25 are configured for attachment to the seat base 28, so as to attach or mount the support device 10 to the golf car 1, as described below.

Preferably, a pair of mounting holes 64 extend through each plate 25, each hole 64 preferably provided through a separate one of a pair of cylindrical projections 67 extending from the lower surface 27 of each plate 25, as best shown in FIG. 8 (see also FIGS. 3 and 4). A fastener 65 (FIG. 3), such as a bolt or a rivet, extends through each mounting hole 64 to removably attach the brackets 20, and thus the support device 10, to the seat base 28. Although it is preferred to use fasteners 65 to removably attach the brackets 20 to the seat base 28, the brackets 20 may be fixedly or removably attached to the seat base 28 by any appropriate means. For example, mounting clips may be used instead of fasteners, the brackets 20 may be engaged with or by separate brackets attached to the seat base 28 or an adhesive substance may be used to permanently or semi-permanently bond each bracket 20 to the seat base 28 (none depicted).

As a further alternative, the mounting plates 25 may each be configured to attach the support device 10 to another portion of the golf car 1, such as to a section of the golf car body 3 proximal to the seat assembly 2 (not depicted), as long as the support tube 12 is disposed generally adjacent to one side 28*a* or 28*b* of the seat base 28. In addition or alternatively, the brackets 20 may be configured for attachment to a central region of the seat base 28, such as if it is desired to provide one or more support devices 10 located between driver and passenger regions (not indicated) of the seat assembly 2.

Referring to FIGS. 3, 4, 6, 7 and 9–11, each mounting bracket 20 preferably includes a reinforced connective portion 66 extending between the inner end 21 of the plate 25 and the inner sidewall 46 of the base shell 32. The connective portions 66 each include a sloped wall 68 having an upper edge attached to the sidewall 46, a lower edge attached to the plate 25 and a protruding or "humped" central section 69 for increased rigidity. Further, a pair of generally triangular end walls 70 extends between the side edges of each sloped wall 68 and the inner shell sidewall 46. Each connective portions 66 also preferably includes a set of reinforcing ribs 72 (see FIGS. 3, 4, 8 and 11) extending between the shell sidewall 46 and the inner surface of the sloped wall 68 and another set of reinforcing ribs 74 (see FIGS. 6 and 7) extending from the outer surface of the sloped wall 68 to the mounting surface 26 of the bracket plate 25.

By forming each bracket 20 with a reinforced connective portion 66 as described above, the support device 10 is capable of resisting relatively substantial bending moments (arising from forces applied to the support tube 12) without the base 16 becoming sheared from the brackets 20. However, it is within the scope of the present invention to construct the mounting brackets 20 without the connective portions 66 as described above, for example by forming the device 10 such that the inner end 21 of each plate 25 is directly attached to the base 16, or with connective portions having another appropriate structure (neither alternative depicted).

Referring now to FIGS. 3, 4, 6 and 8–11, each mounting bracket 20 preferably includes a vertical perimeter wall 76 extending about the three free or unattached edges of the plate 25. Further, a plurality of reinforcing ribs 78 are integrally formed with each bracket plate 25. The ribs 78 extend vertically from the second or lower wall surface 27 of each plate 25 and generally between the inner surfaces of the bracket perimeter wall 76. Preferably, the reinforcing ribs 78 are arranged such that a portion of the ribs 78 each intersect with at least one of the remaining ribs 78 to form a reinforcing grid 80, as shown in FIGS. 3, 4 and 8.

By constructing each bracket 20 as a plate 25 reinforced by ribs 78 and a perimeter wall 76, each bracket 20 has a substantial overall vertical thickness $t_o$ (see FIG. 9) of about the maximum height/vertical length of the ribs 78 added to the thickness of the plate 25 (neither dimension indicated). With this structure, the brackets 20 each have a rigidity and strength that approaches that of a solid plate or block (neither shown) with a thickness $t_o$. However, the brackets 20 are fabricated using substantially less material than such a solid plate/block and are thus produced at a lower material cost.

Although the support device 10 preferably includes two of the mounting brackets 20 formed as described above, it is within the scope of the present invention to construct the mounting brackets 20 in any other appropriate configuration(s) which enable the device 10 to function generally as described herein. For example, the support device 10 may include only a single mounting bracket 20, preferably extending from about the center of the base 16, or may have three or more mounting brackets 20(neither configuration shown). Further for example, the mounting plate 25 may be constructed with a substantially greater thickness than depicted in the drawings (e.g., with a thickness of $t_o$) and without the reinforcing wall 76 and ribs 78, although material usage would then not be minimized as discussed above.

The support device 10 of the present invention is preferably formed in a manufacturing process known as gas-assist injection molding (hereinafter referred to as "GAIM"), as discussed below. Further, the support device 10 is preferably fabricated of fiberglass-filled nylon, although any other appropriate material, such as for example polypropylene or non-filled nylon, may alternatively be used to construct the support device 10.

As GAIM processes are known, a detailed description of this particular manufacturing process is beyond the scope of the present disclosure. However, a discussion of certain structural features of the support device 10, and the benefits of using a GAIM process to produce these features, follows in order to make apparent the importance of the present invention.

By being formed in a GAIM process, the support device 10 can be constructed with both the hollow support tube 12 and the substantially sized, reinforced mounting brackets 20. A standard injection molding process is incapable of producing a one-piece member/device having an enclosed tubular section integrally formed with a base and/or brackets. Instead, to form a support device with a generally enclosed tubular section using standard injection molding processes requires that two or more curved pieces be separately formed and then attached together in a subsequent process to provide such a tubular section. A support device produced of two or more connected-together pieces is more costly to produce, and generally less strong due to weakness at the interface between attached pieces, than the one-piece construction of the present support device 10.

Further, a one-piece support device (not shown) produced in a standard injection molding operation cannot be formed with a hollow tubular support section, but would instead have a support section formed in either of two possible configurations. The single-piece device may have a generally rounded, solid (i.e., not hollow) support portion/section. Forming a solid support section with an outer surface area comparable to that of the support surface 40 requires a significantly greater amount of material than is needed to produce the support tube 12. Alternatively, the single-piece injection molded device may be formed with a bended wall or ledge, as discussed in the Background section. However, as previously noted, a wall/ledge support section has relatively sharp corners compared with the enclosed tubular wall 33 of the support tube 12, such that the "ledge" type of support device is less comfortable to use for gripping and/or resting a golfer's arm than the present support device 10.

Further, a support device produced by a blow-molding process (not shown) may be formed with a hollow tubular section, but can only be produced with a substantially thin bracket portion(s) formed by "pinching off" one or more sections of the parison or preform used for blow-molding the device. Being relatively thin, such brackets are typically weak and cannot resist a significant amount of bending or shearing force applied to the blow-molded support device. Further, a blow-molded support device cannot be made with reinforcing ribs of any substantial thickness, such as the ribs 52, 54, 72 and 74 of the present support device 10, and would therefore have a structure that is significantly weaker than the present support device 10.

Finally, a support device formed of bended metal tubes (not shown) cannot be constructed with flat, integral mounting plates similar to those of the present support device 10. Instead, as discussed in the Background section, such support devices typically require the use of a pair of separate mounting brackets that engage the tube ends to attach the device to a seat assembly. Further, to construct a support device of a bended metal tube having a circumferential surface area comparable to that of the support surface 40 of the present device 10 would result in a device that is significantly heavier and bulkier than the support device 10. In other words, a bended tube would have the increased outer diameter throughout the entire device, not just at the supporting/gripping section, such that the overall size of the support device is greatly increased. Thus, the only feasible alternative is to attach separate pads at the supporting/gripping sections of the tube, requiring a separate assembly step and thereby increasing production costs.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A support device for a seat assembly of a golf car, the device comprising:

a base including an elongated shell bounding an interior space;

a support tube bounding a second interior space and having two opposing ends, at least one tube end being integrally formed with the base; and a mounting bracket integrally formed with the base and including a generally flat wall portion connectable with the golf car to attach the support device to the car, wherein each of the tube ends and the mounting bracket are integrally attached to the base shell and the base shell has a first, enclosed end, the tube end being attached to the enclosed end of the shell, a second, opposing end defining an elongated opening into the interior space and a sidewall extending between the first and second ends, the bracket being attached to the sidewall.

2. A support device for a seat assembly of a golf car, the device comprising:

a base including an elongated shell bounding an interior space;

a support tube bounding a second interior space and having two opposing ends, at least one tube end being integrally formed with the base; and a mounting bracket integrally formed with the base and including a generally flat wall portion connectable with the golf car to attach the support device to the car, wherein each of the tube ends and the mounting bracket are integrally attached to the base shell and the shell has an interior space and the base further includes a plurality of integral reinforcing ribs extending within the interior space.

3. The support device as recited in claim 2 wherein the support tube has a generally bended shape and each of the two tube ends is integrally formed with the base.

4. The support device as recited in claim 2 wherein the support tube has a central axis and a wall that circumscribes the central axis such that the tube has a generally continuous outer circumferential surface.

5. The support device as recited in claim 2, wherein the device is formed in a gas-assist injection molding process.

6. A support device for a seat assembly of a golf car, the device comprising:

a base;

a support tube bounding an interior space and having two opposing ends, at least one tube end being integrally formed with the base; and a mounting bracket integrally formed with the base and including a generally flat wall portion connectable with the golf car to attach the support device to the car, wherein the wall portion of the mounting bracket is formed as a plate having a first, generally flat surface disposable against the golf car seat and a second, opposing surface, the plate being configured for attachment to the seat so as to mount the support device to the golf car, and the mounting bracket further includes a plurality of integral reinforcing ribs extending vertically from the second wall surface such that the bracket has a substantial vertical thickness.

7. The support device as recited in claim 6 wherein a portion of the reinforcing ribs intersect with at least one of the remaining reinforcing ribs to form a reinforcing grid.

8. A seat assembly for a golf car, the seat assembly comprising:

a seat base adapted for mounting to the golf car and having opposing ends and a surface disposed between the ends;

a support device removably attached to the seat base and including:

a base;

a support tube bounding an interior space and having two opposing ends, at least one tube end being integrally formed with the base, and a support surface, disposed adjacent to an end of the seat base; and a mounting bracket integrally formed with the base and including a generally flat wall portion disposeable against the seat base surface and configured to removably attach the support device to the seat base wherein the base includes an elongated shell bounding an interior space and having a first, enclosed end, the tube end being attached to the enclosed end of the shell, a second, opposing end defining an elongated opening into the interior space and a sidewall extending between the first and second ends, the mounting bracket being integrally attached to the sidewall.

9. The seat assembly as recited in claim 8, wherein the support tube has a generally bended shape and each of the two tube ends is integrally formed with the base.

10. The seat assembly as recited in claim 8 wherein the support tube has a central axis and a wall that circumscribes the central axis such that the tube has a generally continuous outer circumferential surface.

11. The seat assembly as recited in claim 8 wherein the device is formed in a gas-assist injection molding process.

12. A seat assembly for a golf car, the seat assembly comprising:

a seat base adapted for mounting to the golf car and having opposing ends and a surface disposed between the ends;

a support device removably attached to the seat base and including:

a base;

a support tube bounding an interior space and having two opposing ends, at least one tube end being integrally formed with the base, and a support surface disposed adjacent to an end of the seat base; and a mounting bracket integrally formed with the base and including a generally flat wall portion disposeable against the seat base surface and configured to removably attach the support device to the seat base wherein the base includes an elongated shell bounding an interior space and having a first, enclosed end, the tube end being attached to the enclosed end of the shell, a second, opposing end defining an elongated opening into the interior space and a sidewall extending between the first and second ends, the mounting bracket being integrally attached to the sidewall, the shell has an interior space and the base further includes a plurality of integral reinforcing ribs extending within the interior space.

13. A seat assembly for a golf car, the seat assembly comprising:

a seat base adapted for mounting to the golf car and having opposing ends and a surface disposed between the ends;

a support device removably attached to the seat base and including:

a base;

a support tube bounding an interior space and having two opposing ends, at least one tube end being integrally formed with the base, and a support surface disposed adjacent to an end of the seat base; and a mounting bracket integrally formed with the base and including a generally flat wall portion disposeable against the seat base surface and configured to removably attach the support device to the seat base wherein the mounting bracket wall portion has a surface and the mounting bracket further includes a plurality of integral reinforcing ribs extending vertically from the wall surface such that the bracket has a substantial vertical thickness.

14. A support device for a seat assembly of a golf car, the device comprising:

a base including an elongated shell bounding an interior space having a first, enclosed end, a second, opposing end defining an elongated opening into the interior space and a sidewall extending between the ends;

a support tube bounding an interior space and having a generally bended shape and two opposing ends, each tube end being integrally formed with the enclosed end of the base shell; and a mounting bracket integrally formed with the sidewall of the base shell and including a plate having a first, generally flat surface disposeable against the golf car seat and configured for attachment to the seat assembly to attach the support device to the golf car.

15. The support device as recited in claim 14 wherein:

the base shell has opposing interior surfaces and the base further includes a plurality of reinforcing ribs extending between the shell interior surfaces; and the bracket plate has a second surface opposing the first surface and the mounting bracket further includes a plurality of reinforcing ribs extending vertically from the second wall surface such that the bracket has a substantial vertical thickness.

16. The support device as recited in claim 14 wherein the support device is formed in a gas-assist injection molding process.

* * * * *